United States Patent [19]

Chacko et al.

[11] Patent Number: 4,870,814

[45] Date of Patent: Oct. 3, 1989

[54] PROCESS FOR MANUFACTURING CORROSION RESISTANT CABLE

[75] Inventors: Tharayil Chacko, Moberly; Wayne Soucie, Columbia; Elroy J. Tauer; Robert Heimann, both of Moberly, all of Mo.

[73] Assignee: Orscheln Co., Moberly, Mo.

[21] Appl. No.: 187,745

[22] Filed: Apr. 29, 1988

[51] Int. Cl.[4] ..... D07B 1/16; D07B 1/14

[52] U.S. Cl. ..... 57/217; 57/7; 57/223; 57/232; 57/295

[58] Field of Search ..... 57/7, 217, 218, 232, 57/295, 296, 223

[56] References Cited

U.S. PATENT DOCUMENTS

| | | | |
|---|---|---|---|
| 3,372,038 | 3/1968 | Weldes et al. . | |
| 3,425,207 | 2/1969 | Campbell | 57/217 |
| 3,509,196 | 4/1970 | Plueddemann et al. | 260/448.2 |
| 3,620,784 | 11/1971 | Schutt | 106/84 |
| 3,646,748 | 3/1972 | Lang | 57/7 X |
| 3,653,930 | 4/1972 | Law et al. | 106/1 |
| 3,700,012 | 10/1972 | Alderfer | 140/149 |
| 3,778,994 | 12/1973 | Humphries | 57/7 X |
| 3,816,184 | 6/1974 | Redmore et al. | 148/6.15 |
| 3,832,204 | 8/1974 | Boaz | 106/287 |
| 3,885,380 | 5/1975 | Hacker | 57/7 X |
| 3,910,797 | 10/1975 | Beers | 106/1 |
| 3,917,648 | 11/1975 | McLeod | 260/32.8 |
| 3,972,304 | 8/1976 | Boucher | 118/44 |
| 3,979,896 | 9/1976 | Klett et al. | 57/7 X |
| 4,084,971 | 4/1978 | Ginsberg | 106/1.17 |
| 4,123,894 | 11/1978 | Hughes et al. | 57/220 |
| 4,162,169 | 7/1979 | Schutt | 106/74 |
| 4,197,695 | 4/1980 | Hughes et al. | 57/217 X |
| 4,239,539 | 12/1980 | Ginsberg et al. | 106/1.17 |
| 4,473,936 | 10/1984 | Kellner et al. | 57/7 X |
| 4,479,829 | 10/1984 | Kniepkamp | 148/1.5 |
| 4,490,969 | 1/1985 | Simpson et al. | 57/217 |

*Primary Examiner*—Donald Watkins

*Attorney, Agent, or Firm*—Arnold, White & Durkee

[57] ABSTRACT

A process is disclosed for manufacturing corrosion resistant cable. In the process, a corrosion resistant, organic based, alkyl silicate-zinc coating solution is applied to wire as the wire is twisted into cable. The solution dries on the wire in air, leaving an inorganic silicate-zinc coating on the wire. The cable is then coated with a plastic. The process is particularly useful for manufacturing brake cables.

15 Claims, 1 Drawing Sheet

PROCESS FOR MANUFACTURING CORROSION RESISTANT CABLE

BACKGROUND OF THE INVENTION

This invention relates to the manufacture of cables comprised of multistrands of metal wire. The invention relates particularly to the manufacture of wire cables that are resistant to corrosion. The invention is especially suited for the manufacture of brake cables and the like.

Metal wire cables will begin quickly to corrode in an outdoor environment without protection. Galvanization provides some protection but in particularly corrosive outdoor environments, such as environments providing frequent exposure to water and salt, more protection is needed. For this reason, automobile brake cables are commonly coated or covered with plastic. The plastic provides effective protection for a time, but the plastic eventually undergoes stress corrosion cracking due to the combined action of tensile stress and a corrosive environment. Typically, such stress corrosion cracking occurs within the time that it takes for an automobile to be driven about 50,000 miles. The cracking can cause sudden and unexpected failures in the brake cables. Better means of protecting such cables is needed.

SUMMARY OF THE INVENTION

The present invention is a process for manufacturing wire cable that is resistant to corrosion. At the point in manufacturing the cable that the (preferably galvanized) wires come together for twisting into cable, the wires are coated with a corrosion resistant coating solution. The solution may be any organic-based alkyl silicate-zinc mixture in which the organic solvent will evaporate and the alkyl silicate ester will hydrolyze and polymerize upon exposure to air to form an inorganic silicate film on the wire. Said film is comprised of about 80 percent to 90 percent zinc. After the coating dries (i.e., the film is formed), the cable is coated with a plastic (having thermoplastic properties).

DETAILED DESCRIPTION OF PREFERRED EMBODIMENT

Figure 1:
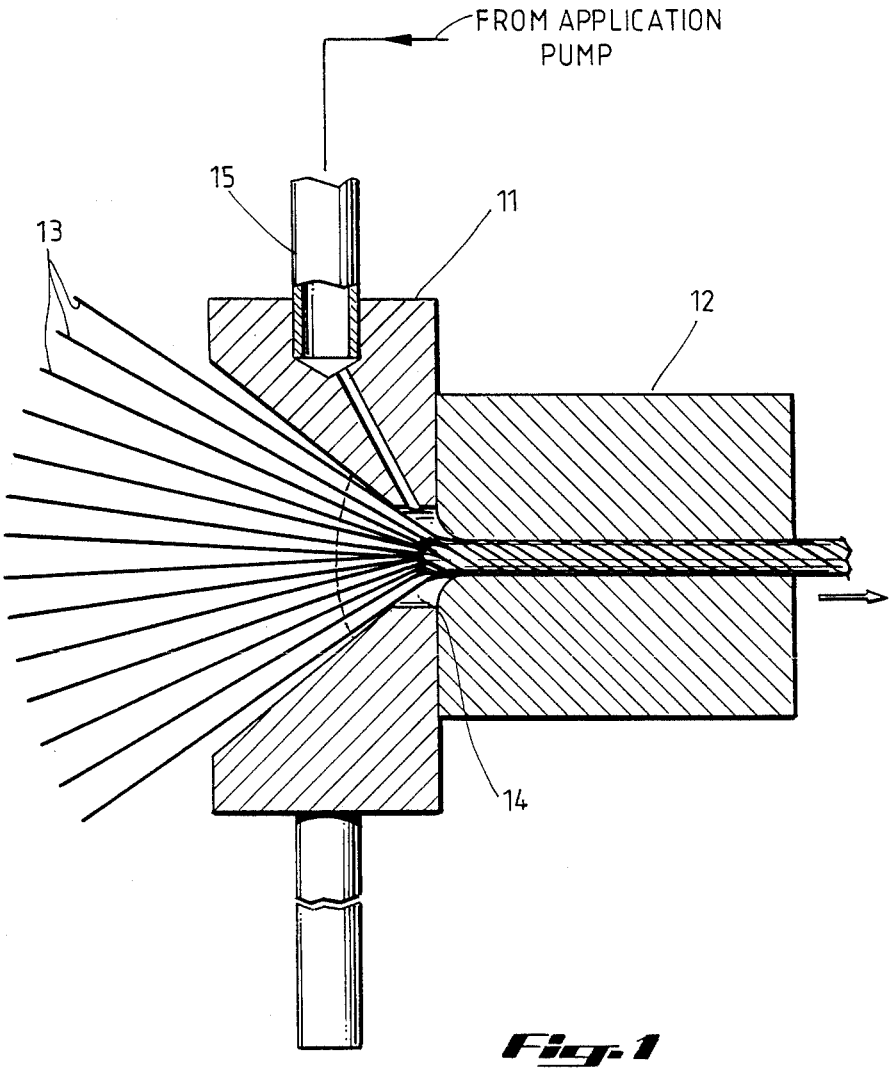
FIG. 1 schematically illustrates an applicator for applying the corrosion resistant solution to wire in accordance with the process of this invention for manufacturing cable.

This invention provides an economical process for manufacturing cables that are resistant to corrosion. When the process is used to manufacture cables such as brake cables that are subject to particularly corrosive environments, such as water and salt, and also tensile stress, the process has been found to significantly increase the expected life of the cables. Automobile brake cables manufactured according to the process of this invention have been found to resist cracking and failure for a period of time extending over 100,000 miles in the life of the car.

The invention is suitable for manufacturing any kind of cable that is comprised of steel, iron or iron alloy or other metal or metal alloy wire that tends to corrode in the presence of water or salt or conditions typical of an outdoor environment. As used herein, the term "cable" or "wire cable" shall be understood to include wire rope, multistranded or filamentous wire, and similar stranded wire products, as well as cables. Preferably, the metal wire selected for manufacturing cable according to the process of this invention will be galvanized, although bare wire may also be used. The wire will also preferably be bright (i.e., clean), or will preferably be prepared for cable manufacture by cleaning or removal of all oils, grease and similar contaminants. The corrosion resistant coating solution applied to the wire in the cable manufacture process of this invention will adhere to the wire most smoothly and evenly when the wire is free of oils and other contaminants.

In practicing the process of this invention, machinery and processes for combining and twisting wires into cable may be used as is common in the industry with the following adaptation for this invention. At the point where the multiple stands of wire (for comprising the cable) come together for twisting into cable, an applicator for applying the corrosion resistant solution is positioned, preferably as shown in FIG. 1. An applicator die 11 is positioned adjacent to the strand closing die 12 so that the wires 13 for comprising the cable will all come together in the applicator die 11 and pass through a pool of corrosion resistant coating solution 14 of said die and pass on into the strand closing die 12. An application pump with meter for controlling flow rate (not shown) pumps the corrosion resistant solution from a supply tank (not shown) into pool 14 through conduit 15 at a controlled rate. The supply tank should be closed to air and preferably have a stirrer to maintain the integrity and homogeneity of the corrosion resistant coating solution 14. An alternate version for an applicator for use in this invention might have extruders for extruding the corrosion resistant coating solution onto the wire instead of providing a pool of solution for the wire to pass through. Other mechanical means might also be adapted for applying solution to the wire in a controlled amount.

The amount of corrosion resistant coating solution to be applied to the wire may vary with the intended use of the wire, the viscosity of the solution, and the rate of application of the solution to the wire. An effective amount of solution for the process of this invention is the amount that completely coats the wire leaving no streaks of uncoated wire and that results in a cable that meets the level of corrosion resistance desired for the intended use of the cable. For example, for a cable to be used in an outdoor corrosive environment, particularly an environment providing frequent exposure to water and salt, such as the environment of a brake cable in an automobile for example, a corrosion protection level of about 400 to 600 hours, as measured by the ASTM B-17 salt spray (fog) testing method, is preferred and obtainable with the process of this invention. This increased level of protection is particularly significant to the automobile industry. Before the process of this invention, a corrosion protection level for brake cables of about 96 hours, as measured by the ASTM B-17 salt spray (fog) testing method, was generally the best practicably obtainable. Given a corrosion resistant coating solution having a viscosity in the range of about 200 cps to about 300 cps, an "effective" amount of such solution in practicing this invention for a brake cable will typically be the amount that will adhere to the wire at a flow rate of about 500 to about 850 ml per 1,000 feet of $\frac{1}{8}$ inch wire strand. For brake cables that are made with a core of, for example, 7 wires, and an outer layer of, for example, 12 wires, the following amounts of corrosion resistant coating solution have been found to be effective: for the 7 wire core, the amount of solution that will adhere to the wires at a flow rate of about 100 to about 200 ml per 1,000 feet of wire strand; and for the 12 wire outer layer, the amount of solution that will adhere to the wire at a flow rate ranging from about 400 to about 650 ml per 1,000 feet of wire strand.

In any event, the rate of application of corrosion resistant coating solution to the wire in the process of this invention should not exceed a rate that enables the wire to be completely coated with the solution. Fluorescent dye may be added to the corrosion resistant coating solution for ease in detecting wire (under ultraviolet light) that is incompletely coated. A preferred amount of dye is between 0.05% and 0.17% dissolved in alcohol, preferably isopropyl alcohol. Preferably, each wire comprising the cable will be completely coated with the corrosion resistant solution.

Corrosion resistant coating solutions suitable for the process of this invention are alkyl silicate-zinc mixtures in an organic base. Any alkyl silicate ester that will hydrolyze and subsequently polymerize to an inorganic silicate in the presence of air may be used. Any organic base that will evaporate in air at room temperature and not react with the alkyl silicate or zinc may be used. A preferred solution of alkyl silicate in organic base for the practice of this invention is ORSIL TM, available from the Orscheln Co. of Moberly, Mo. ORSIL TM is comprised of tetra ethyl ortho silicate (or tetra methyl silicate; although tetra ethyl ortho silicate is preferred), in an organic solvent base, preferably mono hydroxy alcohols such as isopropanol, ethanol and/or methanol, with mica (in the range of about 3% to about 9% by weight) and small amounts (about 0.03% to about 2.5%) of moisture scavenger and antisettling agents. A thickener may be added to increase the viscosity as desired. To this base, fine zinc dust or powder, sufficient in quantity so that when the solution is applied to a wire and allowed to dry in air (i.e., the organic solvent evaporates and the alkyl silicate ester hyrolyzes and polymerizes to an inorganic silicate or inorganic matrix of inorganic silicate), the resulting dried film on the wire will be comprised of between about 80 percent to about 90 percent zinc.

A corrosion resistant coating solution for use in this invention may be prepared in ways known to those skilled in the art. The following way, with ORSIL TM, is a typical example. ORSIL TM is homogenized in a closed, stainless steel or plastic mixing tank. Fine zinc powder is added slowly (at a rate ranging from about 100 to about 150 pounds per hour) in an amount ranging from about 50 percent to about 75 percent by weight of the ORSIL TM and mixed in an explosion proof mixer equipped with a stainless steel agitator. The mixing is preferably at a moderate rate at about 200 rpm minimum to obtain dispersion of the zinc in the ORSIL TM. The mixture should have only a slight vortex at the surface to avoid introducing air into the solution. Usual precautions against ignition and explosion are taken. The mixing time will vary depending on the quantity of ORSIL TM and zinc used. Mixing is conducted until the solution is free of lumps and appears uniform throughout without separation of zinc or streaks on the surface. A 10 percent solution of fluorescent dye and alcohol is usually added at a quantity ranging from about 2 to 8 milliliters per pound of ORSIL TM. After mixing, the coating solution is strained through a filter less than about 30 mesh in size and stored in a closed, airtight, stainless steel or plastic container until ready for use. The solution may also be strained immediately prior to use instead of or in addition to the straining after mixing. This coating solution has a shelf life of about 48 hours. The viscosity generally ranges from 200 to 300 cps (at 70° F., Brookfield Viscometer, 20 RPM No. 2 Spindle), but may be made thinner by diluting the mixture with alcohol. The flashpoint of the solution ranges from about 50° to 65° F. per ASTM D93.

Further according to the practice of this invention, following coating of the wire and formation of the cable as described above, the cable should be set aside to allow the coating to fully cure. Under normal atmospheric conditions, the coating will be fully dry within a period of about twelve to seventy-two hours. High humidity slows the drying process. The coating may be cured faster in a gas or electrically fired oven, vented to air, and having temperatures ranging from about 250° F. to about 450° F. for a period ranging from about three to ten hours.

After the coating is dry, the cable is preferably coated with a plastic having thermoplastic properties. A typical thermoplastic suitable for use on brake cables made according to the process of this invention is a copolyester type plastic.

EXAMPLES

The following examples further illustrate the practice of this invention. The examples are directed to applying the process of the invention in manufacturing wire cable comprising an outer layer of 12 wires twisted together with an inner core of 7 twisted wires. Each of the wires comprising the cables in both examples below were coated completely with a corrosion resistant coating solution in accordance with the process of this invention. In each example, complete coating was verified by monitoring the fluorescence of the strands under ultraviolet light during the cable fabrication.

EXAMPLE 1

One hundred pounds of ORSIL TM (from Orscheln Co.), having a viscosity of 300 cps was put into an explosion-proof mixer equipped with a stainless steel agitator. Sixty pounds of finely divided zinc powder of six micron size was added to the ORSIL TM slowly at a rate of 120 pounds per hour preferably using a screw feeder and mixed at 200 rpm. About 500 ml of a 10% solution of fluorescent dye in alcohol was added after the addition of the zinc powder to the ORSIL TM was completed. The total mixing time employed was about 45 minutes. The mixed coating solution was then strained through a 20 mesh size filter. The filtered solution had a viscosity of about 250 cps. Within 24 hours after mixing, the solution was applied to the wire (which was galvanized and free of oils) at two stages as follows: first, the solution was applied at a flow rate of 200 ml per 1,000 feet of wire strand to 7 wires as they were combined and twisted together to comprise the cable core; second, the solution was applied at a flow rate of 650 ml per 1,000 feet of the wire strand to 12 wires as they were combined with and twisted onto the 7 wire core to comprise a corrosion protected cable with a 7 wire core and a 12 wire outer layer. The coated wire strand cable was contained on a reel (45,000 linear feet of cable) and allowed to dry in air at a room temperature of 80° F. and humidity of 55% for a period of about 24 hours. After drying, the cable was coated with plastic by plastic extrusion. ASTM B-117 salt spray (fog) testing showed the cable to have an average of 550 hours of corrosion protection.

EXAMPLE 2

Fifty pounds of ORSIL TM (from Orscheln Co.) having a viscosity of 200 cps was mixed with 25 pounds of finely divided zinc powder of six micron size at a rate of 120 pounds per hour using screw feeders and a mixing rate of approximately 200 rpm. About 200 ml of 10% solution of fluorescent dye in isopropyl alcohol was added after initial mixing of the zinc in ORSIL TM. The total mixing time employed was 30 minutes. When the zinc was well dispersed, the mixture was strained through a 30 mesh size filter. The filtered solution was thinned with 1,000 ml of isopropyl alcohol until it had a viscosity of 200 cps. This thinned solution was then applied to galvanized wire at a rate of 100 ml per 1,000 feet for the 7 wire fabrication and at a rate of 400 ml per 1,000 feet for the 12 wire fabrication. The coated strand cable (45,000 linear feet) was allowed to dry on a reel in a gas fired and vented oven at a temperature of 350° F. for about eight hours prior to extruding plastic onto the outside of the cable. ASTM B-117 salt spray (fog) testing showed the cable to have an average of 600 hours of corrosion protection.

The principle of the invention and the best mode contemplated for applying that principle have been described. It is to be understood that the foregoing is illustrative only and that other means and techniques can be employed without departing from the true scope of the invention defined in the following claims.

We claim:

1. A process for manufacturing corrosion resistant wire cable comprising:

completely coating every wire for comprising the cable with a corrosion resistant coating solution comprising an alkyl silicate-zinc mixture in an organic base as the wire is twisted to form the cable;

allowing said coating on said wire comprising said cable to dry by allowing said organic base to evaporate and said alkyl silicate to hydrolyze and polymerize to form a film of inorganic silicate and zinc on said wire; and coating said cable with plastic.

2. The process of claim 1 wherein said wire is galvanized prior to coating with said corrosion resistant coating solution.

3. The process of claim 1 wherein said wire is cleaned free of oil, grease and other similar contaminants prior to coating with said corrosion resistant coating solution.

4. The process of claim 1 wherein said coating on said wire, when dry, essentially consists of inorganic silicate and about 80% to about 90% zinc.

5. The process of claim 1 wherein said drying is in air.

6. The process of claim 5 wherein the period of time for said drying is about 12 hours to about 72 hours.

7. The process of claim 1 wherein said drying is in an oven, vented to air, at a temperature in the range of about 250° F. to about 450° F.

8. The process of claim 7 wherein the period of time for said drying is about 3 to about 10 hours.

9. The process of claim 1 wherein said coating solution is applied to the wire at a rate that will provide even coating of the wire.

10. The process of claim 1 wherein said coating solution further comprises a fluorescent dye in an alcohol base for monitoring said coating of said wire for comprising the cable.

11. A process for manufacturing an automobile brake cable comprising:

providing galvanized strands of metal wire, free of oil, grease and similar contaminants, for comprising the cable;

completely coating said strands with an organic based alkyl silicate-zinc solution just as the strands are beginning to be twisted into cable;

completely twisting said strands into cable;

allowing said coating on said strands comprising the cable to dry; and coating said cable with plastic.

12. A corrosion resistant wire cable comprising wire completely coated with inorganic silicate and zinc, wherein said zinc comprised about 80% to about 90% of said coating, and further comprising an outside coating of plastic.

13. The corrosion resistant wire cable of claim 12 wherein said wire is also galvanized.

14. A corrosive resistant wire cable essentially comprising galvanized wire individually coated completely with inorganic silicate and zinc wherein said zinc comprises about 80% to about 90% of said coating.

15. An automobile brake cable comprising:

galvanized wires, each completely coated with inorganic silicate and zinc wherein said zinc comprised about 80% to about 90% of said coating on said wires and wherein said coating is obtained by controllably and evenly applying an organic-based alkyl silicate-zinc solution to the wires as the wires are being twisted to comprise the cable and allowing the solution to dry on the wires comprising the cable; and an exterior coating of plastic.

* * * * *

UNITED STATES PATENT AND TRADEMARK OFFICE

CERTIFICATE OF CORRECTION

PATENT NO. : 4,870,814

DATED : October 3, 1989

INVENTOR(S) : T. Chacko, et al

It is certified that error appears in the above-identified patent and that said Letters Patent is hereby corrected as shown below:

Claim 12, the phrase "wherein said zinc comprised about should read --wherein said zinc comprises about--

Claim 15, the phrase "wherein said zinc comprised about " should read --wherein said zinc comprises about--

Signed and Sealed this

Fourteenth Day of August, 199(

*Attest:*

HARRY F. MANBECK, JR.

*Attesting Officer*

*Commissioner of Patents and Trademarks*